US010873121B2

(12) United States Patent
Goto et al.

(10) Patent No.: US 10,873,121 B2
(45) Date of Patent: Dec. 22, 2020

(54) ANTENNA DEVICE

(71) Applicant: MITSUBISHI ELECTRIC CORPORATION, Tokyo (JP)

(72) Inventors: Jun Goto, Tokyo (JP); Satoshi Yamaguchi, Tokyo (JP); Masataka Otsuka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 224 days.

(21) Appl. No.: 16/066,263

(22) PCT Filed: Feb. 5, 2016

(86) PCT No.: PCT/JP2016/053515
§ 371 (c)(1),
(2) Date: Jun. 26, 2018

(87) PCT Pub. No.: WO2017/134819
PCT Pub. Date: Aug. 10, 2017

(65) Prior Publication Data

US 2018/0375183 A1 Dec. 27, 2018

(51) Int. Cl.
*H01Q 13/10* (2006.01)
*H01Q 21/06* (2006.01)
(Continued)

(52) U.S. Cl.
CPC ..... *H01P 3/085* (2013.01); *H01P 3/06* (2013.01); *H01Q 1/40* (2013.01); *H01Q 13/10* (2013.01);
(Continued)

(58) Field of Classification Search
CPC .. H01Q 13/10; H01Q 21/005; H01Q 21/0075; H01Q 21/0081; H01Q 1/40;
(Continued)

(56) References Cited

U.S. PATENT DOCUMENTS 4,401,988 A * 8/1983 Kaloi ..... H01Q 19/005 343/700 MS
4,658,259 A * 4/1987 Blaese ..... H01Q 1/3283 343/713
(Continued)

FOREIGN PATENT DOCUMENTS

EP 0 384 777 A2 8/1990
JP 8-130410 A 5/1996
JP 08130410 A * 5/1996

OTHER PUBLICATIONS

Bhattacharyya et al., "Analysis of Stripline-Fed Slot-Coupled Patch Antennas with Vias for Parallel-Plate Mode Suppression", IEEE Transactions on Antennas and Propagation, vol. 46, No. 4, Apr. 1998, pp. 538-545.
(Continued)

*Primary Examiner* — Graham P Smith
*Assistant Examiner* — Jae K Kim
(74) *Attorney, Agent, or Firm* — Birch, Stewart, Kolasch & Birch, LLP

(57) ABSTRACT

A ground conductor (1) having slots (2*a* to 2*g*) for radiating electromagnetic waves, a ground conductor (3) in which cavities (4) recessed in a direction away from the ground conductor (1) is formed in positions opposite to the slots (2*a* to 2*g*) of the grounding conductor (1), and central conductors (5*a*, 5*b*, 6*a* to 6*c*, 7*a*, and 7*b*) arranged in positions overlapping with the slots (2*a* to 2*g*), respectively, between the ground conductor (1) and the ground conductor (3) are provided. The central conductors (5*a*, 5*b*, 6*a* to 6*c*, 7*a*, and 7*b*) are arranged such that the ground conductor (1) is closer to them than the ground conductor (3).

6 Claims, 7 Drawing Sheets

(51) Int. Cl.

| | |
|---|---|
| ***H01Q 1/40*** | (2006.01) |
| ***H01Q 21/00*** | (2006.01) |
| ***H01P 3/08*** | (2006.01) |
| ***H01P 3/06*** | (2006.01) |
| ***H01Q 13/18*** | (2006.01) |
| *H01P 5/107* | (2006.01) |

(52) U.S. Cl.
CPC ..... *H01Q 13/106* (2013.01); *H01Q 13/18* (2013.01); *H01Q 21/005* (2013.01); *H01Q 21/0075* (2013.01); *H01Q 21/0081* (2013.01); *H01Q 21/064* (2013.01); *H01P 5/107* (2013.01)

(58) Field of Classification Search
CPC .... H01Q 13/106; H01Q 13/18; H01Q 21/064; H01P 3/085; H01P 3/06; H01P 5/107
See application file for complete search history.

(56) References Cited

U.S. PATENT DOCUMENTS 4,804,969 A * 2/1989 Blaese ..... H01Q 1/1285 343/713
5,025,264 A 6/1991 Stafford
RE33,743 E * 11/1991 Blaese ..... H01Q 1/1285 343/715
5,302,872 A * 4/1994 Ohki ..... H02K 41/031 310/12.19
2004/0004576 A1 1/2004 Anderson
2011/0025566 A1* 2/2011 Suh ..... H01Q 1/2266 343/702
2011/0032157 A1* 2/2011 Suh ..... H01Q 5/371 343/702
2011/0248891 A1 10/2011 Han et al.
2011/0285427 A1* 11/2011 Koyama ..... H01L 24/73 327/109
2013/0119977 A1* 5/2013 Sheikman ..... G01B 15/00 324/207.11
2017/0346188 A1* 11/2017 Shimura ..... H01Q 1/38

OTHER PUBLICATIONS

International Search Report for PCT/JP2016/053515 (PCT/ISA/210) dated Apr. 19, 2016.
Japanese Office Action issued in Japanese Patent Application No. 2016-542781 dated Sep. 13, 2016.
Nakayama et al., "A Triplate-Type Aperture Antenna Backed by a Cavity", Journal of the Institute of Electronics, Information and Communication Engineers B, vol. J82-B, No. 3, pp. 410-419, Mar. 1999.
Park et al., "Design of Transverse Slot Arrays Fed by Boxed Stripline", Antennas and Propagation Society International Symposium Digest, IEEE, 1981, pp. 428-431.
Office Action issued in corresponding European Application No. 16 889 305.5 dated Sep. 17, 2019.

* cited by examiner

ANTENNA DEVICE

TECHNICAL FIELD

The present invention relates to an antenna device in which a triplate line is used as a feeder line.

BACKGROUND ART

An antenna device disclosed in Non-Patent Literature 1 listed below includes a triplate line formed of an upper ground plate in which an aperture is formed, a lower ground plate, and a strip line arranged between the upper ground plate and the lower ground plate.

Since electromagnetic waves propagating through the triplate line have a small attenuation amount and are in a stable state, it is difficult for the electromagnetic waves to radiate from the aperture formed in the upper ground plate. Thus, a cavity is formed in the lower ground plate in a position opposite to the aperture formed in the upper ground plate. This cavity is a recessed portion recessed in a direction away from the upper ground plate.

Since the cavity is formed in the lower ground plate, the stable state is broken, so that electromagnetic waves are radiated from the aperture formed in the upper ground plate.

The antenna device disclosed in Patent Literature 1 listed below is further provided with a third conductor plate and a second feeder line in addition to a first conductor plate corresponding to the above-described upper ground plate, a second conductor plate corresponding to the above-described lower ground plate, and a first feeder line corresponding to the above-described strip line, and the triplate line is formed to have a two-layered configuration.

Also in this antenna device, a cavity is formed in the second conductor plate in a position opposite to an aperture formed in the first conductor plate.

CITATION LIST

Patent Literatures

Patent Literature 1: JP 1996-130410 A (FIG. 1)

Non-Patent Literature

Non-Patent Literature 1: Nakayama, Nakano, "A Triplate-Type Aperture Antenna Backed by a Cavity" Journal of the Institute of Electronics, Information and Communication Engineers B, Vol. J82-B, No. 3, pp. 410-419, March 1999.

SUMMARY OF INVENTION

Technical Problem

Since conventional antenna devices are configured as described above, it is possible to brake the stable state by the cavity formed in the lower ground plate. However, in order to break the stable state, the depth of the cavity of approximately 0.25 wavelength is required. Therefore, there is a problem that the triplate line serving as the feeder line of the antenna device becomes thick.

The present invention is made to solve the above-described problem, and an object thereof is to provide an antenna device capable of reducing the thickness of a feeder line.

Solution to Problem

An antenna device according to the present invention includes: a first ground conductor having slot for radiating an electromagnetic wave; a second ground conductor on which a cavity recessed in a direction away from the first ground conductor is formed in a position opposite to the slot of the first ground conductor; and a first central conductor arranged between the first ground conductor and the second ground conductor in a position overlapping with the slot, the first central conductor being arranged such that the first ground conductor is closer to the first central conductor than the second ground conductor; and a disturbing conductor disturbing an electromagnetic field between the first ground conductor and the second ground conductor.

Advantageous Effects of Invention

According to the present invention, since the first central conductor is arranged such that the first ground conductor is closer to the first central conductor than the second ground conductor and a disturbing conductor disturbing an electromagnetic field is provided between the first ground conductor and the second ground conductor, there is an effect that the thickness of the feeder line composed of the first and second ground conductors and the first central conductor can be reduced.

DESCRIPTION OF EMBODIMENTS

Some embodiments of the present invention will be described hereinafter with reference to the accompanying drawings in order to describe the present invention in more detail.

First Embodiment

Figure 1:
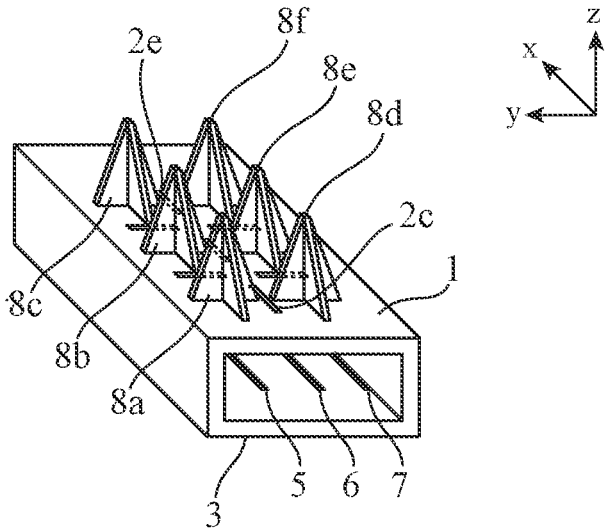
FIG. 1 is a perspective view illustrating an antenna device according to a first embodiment of the present invention.
Figure 2:
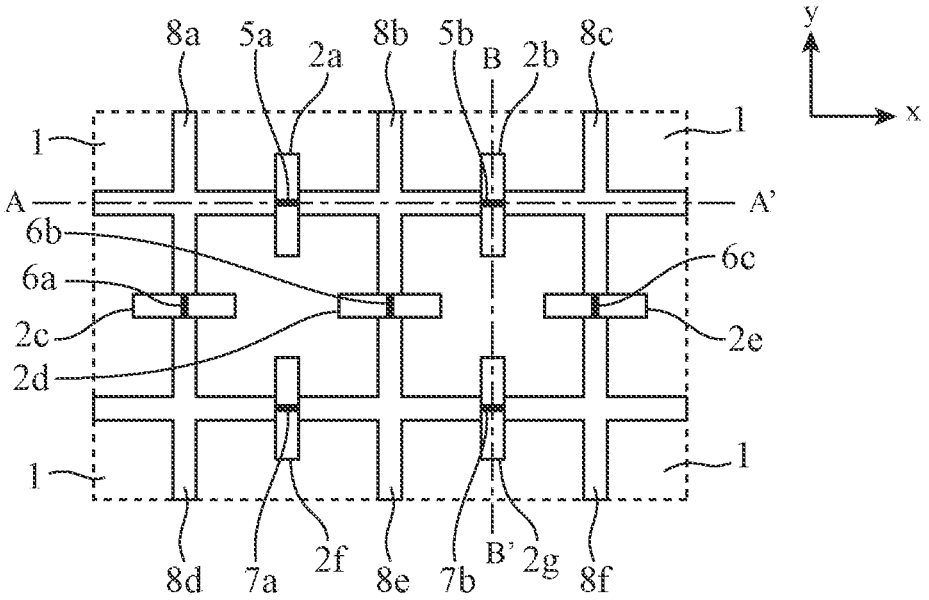
FIG. 2 is a top view illustrating the antenna device according to the first embodiment of the present invention.

FIG. 1 is a perspective view illustrating an antenna device according to a first embodiment of the present invention, and FIG. 2 is a top view illustrating the antenna device according to the first embodiment of the present invention.

Figure 3:
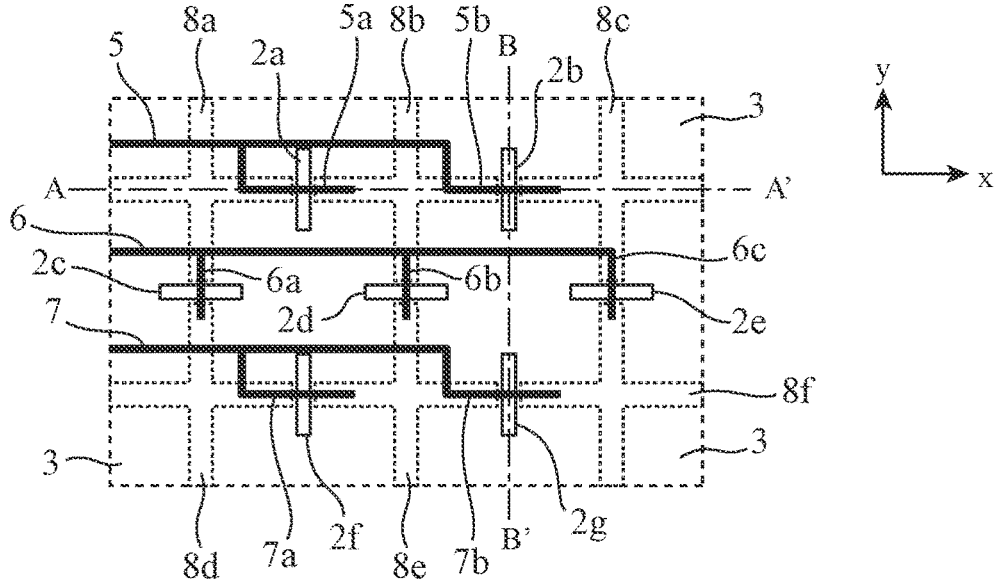
FIG. 3 is a top view illustrating the antenna device in a state in which a ground conductor 1 is removed from the antenna device in FIG. 2 and central conductors 5, 6, and 7 are visible.
Figure 4:
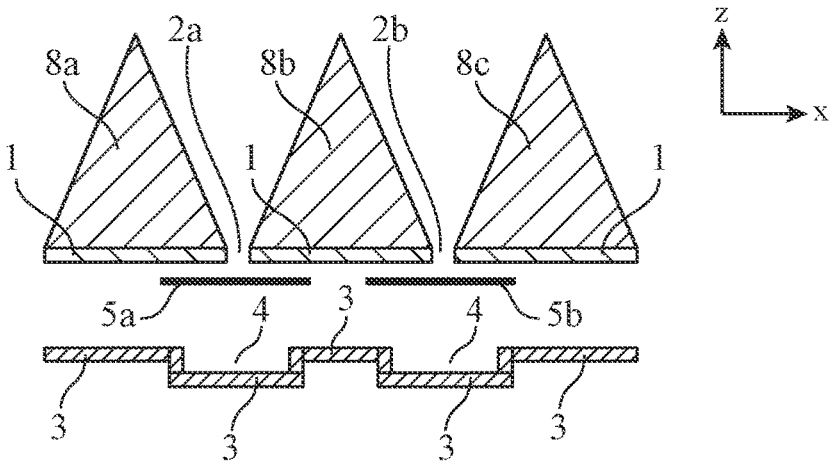
FIG. 4 is a cross-sectional view taken along line A-A' in the antenna device in FIG. 2.
Figure 5:
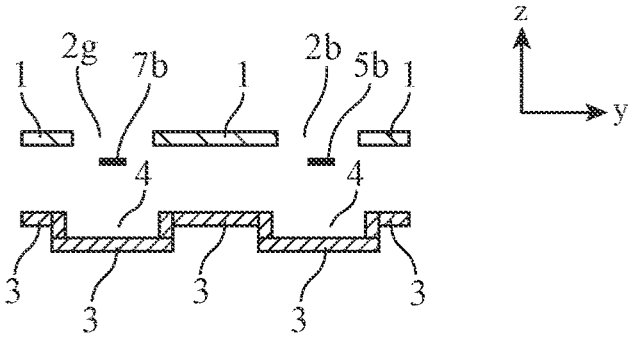
FIG. 5 is a cross-sectional view taken along line B-B' in the antenna device in FIG. 2.

FIG. 3 is a top view illustrating the antenna device in a state in which a ground conductor 1 is removed from the antenna device in FIG. 2 and central conductors 5, 6, and 7 are visible, FIG. 4 is a cross-sectional view taken along line A-A' of the antenna device in FIG. 2, and FIG. 5 is a cross-sectional view taken along line B-B' of the antenna device in FIG. 2.

In FIGS. 1 to 5, the ground conductor 1 is a first ground conductor having apertures for radiating electromagnetic waves.

Slots 2*a* to 2*g* are apertures formed in the ground conductor 1 and electromagnetic waves are radiated from the slots 2*a* to 2*g* to the space.

A ground conductor 3 is a second ground conductor.

In the ground conductor 3, cavities 4 are formed to be recessed in a direction away from the ground conductor 1 in positions opposite to the slots 2*a* to 2*g* formed in the ground conductor 1. In an example in FIG. 4, the cavities 4 are formed in the ground conductor 3 to be recessed downward on the drawing sheet.

The central conductors 5, 6, and 7 are first central conductors arranged between the ground conductor 1 and the ground conductor 3.

The central conductor 5 includes a central conductor 5*a* branched from an intermediate point of the central conductor 5 and a central conductor 5*b* formed by bending an end of the central conductor 5. The central conductor 6 includes central conductors 6*a* and 6*b* each branched from an intermediate point of the central conductor 6 and a central conductor 6*c* formed by bending an end of the central conductor 6. The central conductor 7 includes a central conductor 7*a* branched from an intermediate point of the central conductor 7 and a central conductor 7*b* formed by bending an end of the central conductor 7. In an example in FIG. 3, the ends of the central conductors 5, 6, and 7 are on the right side on the drawing sheet.

The central conductor 5*a* is arranged in a position overlapping with the slot 2*a*, and the central conductor 5*b* is arranged in a position overlapping with the slot 2*b*. The central conductor 6*a* is arranged in a position overlapping with the slot 2*c*, the central conductor 6*b* is arranged in a position overlapping with the slot 2*d*, and the central conductor 6*c* is arranged in a position overlapping with the slot 2*e*. The central conductor 7*a* is arranged in a position overlapping with the slot 2*f*, and the central conductor 7*b* is arranged in a position overlapping with the slot 2*g*.

The central conductors 5*a*, 5*b*, 6*a*, 6*b*, 6*c*, 7*a*, and 7*b* are arranged such that the ground conductor 1 is closer to them than the ground conductor 3.

Tapered conductors 8*a* to 8*f* are connected to an upper side of the ground conductor 1.

Each of the tapered conductors 8*a* to 8*f* has a cross shape as illustrated in FIGS. 2 and 3 when the antenna device is seen from above, and has a triangular shape as illustrated in FIG. 4 when the antenna device is seen from a side thereof.

The tapered conductors 8*a* to 8*f* are mounted in order to widen the band of the antenna device. In a case in which the widening of the band is not required, it is not necessary to mount the tapered conductors 8*a* to 8*f*.

Next, the operation of the antenna device will be described.

The antenna device of the first embodiment includes a triplate line formed of the ground conductor 1 in which the slots 2*a* to 2*g* are formed, the ground conductor 3 in which the cavities 4 are formed, and the central conductor 5 arranged between the ground conductor 1 and the ground conductor 3. This antenna device also includes a triplate line formed of the ground conductor 1, the ground conductor 3, and the central conductor 6, and a tri-plate line formed of the ground conductor 1, the ground conductor 3, and the central conductor 7.

These triplate lines are used as feeder lines of the antenna device, and electromagnetic waves propagating through the triplate lines are in a stable state with a small attenuation amount. In the stable state, it is difficult to radiate the electromagnetic waves from the slots 2*a* to 2*g* formed in the ground conductor 1 to the space.

In order to operate the device as an antenna, it is necessary to radiate electromagnetic waves from the slots 2*a* to 2*g* formed in the ground conductor 1 to the space.

Therefore, the cavity 4 is formed in the ground conductor 3 in order to break the stable state. However, in order to break the stable state only by the cavity 4, a depth of the cavity 4 of approximately 0.25 wavelength is required, so that the triplate line serving as the feeder line becomes thick.

Therefore, in this first embodiment, in order to break the stable state even in a case in which the depth of the cavity 4 is designed to be small, the central conductors 5*a*, 5*b*, 6*a*, 6*b*, 6*c*, 7*a*, and 7*b* are arranged such that the ground conductor 1 is closer to them than the ground conductor 3.

By arranging the central conductors 5*a*, 5*b*, 6*a*, 6*b*, 6*c*, 7*a*, and 7*b* such that the ground conductor 1 is closer to them than the ground conductor 3 in this manner, the slots 2*a* to 2*g* serving as discontinuous points in the ground conductor 1 approach the central conductors 5*a*, 5*b*, 6*a*, 6*b*, 6*c*, 7*a*, and 7*b*, respectively, so that an electromagnetic field in the triplate line is disturbed by the effect of the discontinuous points, and the stable state can be broken.

For example, when the distance between the ground conductor 1 and the ground conductor 3 is 0.03 wavelength, by setting the distance between the central conductors 5*a*, 5*b*, 6*a*, 6*b*, 6*c*, 7*a*, and 7*b* and the ground conductor 1 to approximately 0.01 wavelength, the stable state can be broken even when the depth of the cavity 4 is about 0.08 wavelength.

Note that, in a case in which the central conductors 5*a*, 5*b*, 6*a*, 6*b*, 6*c*, 7*a*, and 7*b* are arranged in the center between the ground conductor 1 and the ground conductor 3, the depth of the cavity 4 of approximately 0.25 wavelength is required in order to break the stable state.

As can be understood from the above description, according to the first embodiment, the central conductors 5*a*, 5*b*, 6*a*, 6*b*, 6*c*, 7*a*, and 7*b* are arranged such that the ground conductor 1 is closer to them than the ground conductor 3, so that there is an effect that the stable state is broken and electromagnetic waves can be radiated from the slots 2*a* to 2*g* to the space even in a case in which the thickness of the feeder lines formed of the ground conductors 1 and 3 and the central conductors 5*a*, 5*b*, 6*a*, 6*b*, 6*c*, 7*a*, and 7*b* is designed to be small.

In this first embodiment, an example in which each of the slots 2*a* to 2*g* has a rectangular shape is described. However, its shape is not limited thereto, and the shape of each of the slots 2*a* to 2*g* may be the shape of the letter H, for example.

Further, the shape of each of the slots 2*a* to 2*g* may be a shape whose end parts are rounded.

For example, in a case in which the slots 2*a* to 2*g* are formed by machine cutting, the end parts of the slots 2*a* to 2*g* may be rounded.

In this first embodiment, each antenna element in the antenna device includes a slot 2 and a central conductor. That is, the slot 2*a* and the central conductor 5*a* form one antenna element, and the slot 2*b* and the central conductor 5*b* form one antenna element.

Further, the slot 2*c* and the central conductor 6*a* form one antenna element, the slot 2*d* and the central conductor 6*b* form one antenna element, and the slot 2*e* and the central conductor 6*c* form one antenna element.

Moreover, the slot 2*f* and the central conductor 7*a* form one antenna element, and the slot 2*g* and the central conductor 7*b* form one antenna element.

In this first embodiment, an example is illustrated in which the seven antenna elements form a two-dimensional array including two rows in the x-direction and three columns in the y-direction, but this is merely an example; it is possible to arrange any number of antenna elements in the x-direction and the y-direction.

The two-dimensional arrangement of the antenna elements as described above is similar in each of second to fourth embodiments described below.

Second Embodiment

In the first embodiment described above, a configuration for breaking the stable state is shown, in which the central conductors 5*a*, 5*b*, 6*a*, 6*b*, 6*c*, 7*a*, and 7*b* are arranged such that the ground conductor 1 is closer to them than the ground conductor 3. However, in order to break the stable state, it is also possible to provide a disturbing conductor to disturb an electromagnetic field between the ground conductor 1 and the ground conductor 3.

Figure 6:
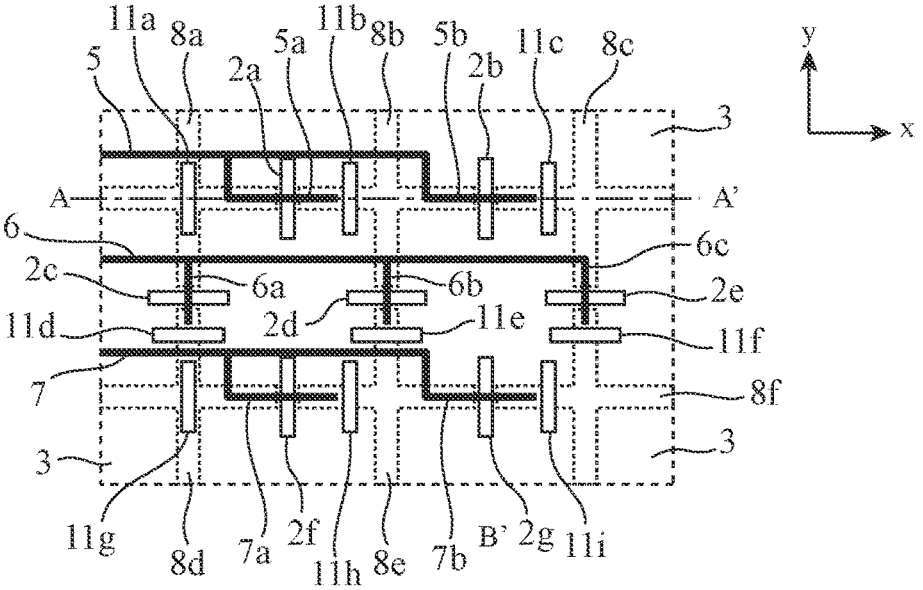
FIG. 6 is a top view illustrating an antenna device according to a second embodiment of the present invention.

FIG. 6 is a top view illustrating an antenna device according to a second embodiment of the present invention. Note that, in FIG. 6, a state in which a ground conductor 1 is removed from the antenna device so that central conductors 5, 6, and 7 are visible is illustrated.

Figure 7:
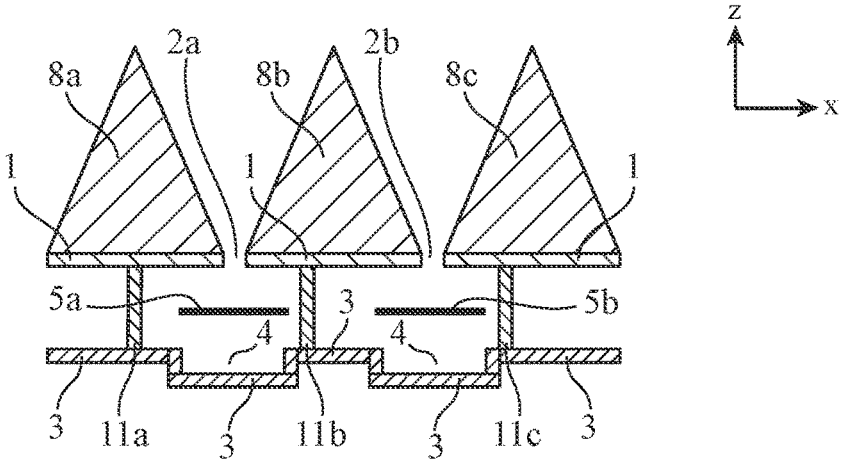
FIG. 7 is a cross-sectional view taken along line A-A' in the antenna device in FIG. 6.

FIG. 7 is a cross-sectional view taken along line A-A' in the antenna device of FIG. 6. Note that, FIG. 7 illustrates the antenna device in a state in which the ground conductor 1 is not removed.

In FIGS. 6 and 7, the same reference signs as those in FIGS. 1 to 5 represent the same or corresponding parts, so that the description thereof is omitted.

Ground conductors 11*a* to 11*i* are third ground conductors. One end of each of the third ground conductors is connected to the ground conductor 1 and the other end thereof is connected to the ground conductor 3. The ground conductors 11*a* to 11*i* are used as disturbing conductors to disturb an electromagnetic field between the ground conductor 1 and the ground conductor 3.

Next, the operation of the device in this embodiment will be described.

In order to break a stable state even when the depth of the cavity 4 is small, thereby radiating electromagnetic waves from slots 2*a* to 2*g* formed in the ground conductor 1 to the space, in the second embodiment, the ground conductors 11*a* to 11*i* are provided in the vicinity of the slots 2*a* to 2*g* as conductors for disturbing the electromagnetic field between the ground conductor 1 and the ground conductor 3. The ground conductors 11*a* to 11*i* serve as discontinuous points when electromagnetic waves propagate.

By this configuration, an electromagnetic field in a triplate line is disturbed by an effect of the discontinuous points provided by the ground conductors 11*a* to 11*i*, so that the stable state can be broken. As a result, it becomes possible to radiate electromagnetic waves from the slots 2*a* to 2*g* to the space.

As can be understood from the above description, according to the second embodiment, the ground conductors 11*a* to 11*i* whose one ends are connected to the ground conductor 1 and the other ends are connected to the ground conductor 3, respectively, are provided between the ground conductors 1 and 3 as the conductors for disturbing the electromagnetic field. As a result, there is an effect that the stable state is broken and the electromagnetic waves can be radiated from the slots 2*a* to 2*g* to the space, even in a case in which the thickness of each of the feeder lines formed of the ground conductors 1 and 3 and the central conductors 5*a*, 5*b*, 6*a*, 6*b*, 6*c*, 7*a*, and 7*b* is designed to be small.

In the second embodiment, an example in which the central conductors 5*a*, 5*b*, 6*a*, 6*b*, 6*c*, 7*a*, and 7*b* are arranged in the center between the ground conductor 1 and the ground conductor 3 is described. Further, as similar to the first embodiment, the central conductors 5*a*, 5*b*, 6*a*, 6*b*, 6*c*, 7*a*, and 7*b* may be arranged such that the ground conductor 1 is closer to them than the ground conductor 3. In this case, the number of elements which break the stable state increases, so that it is possible to break the stable state even when the depth of the cavity 4 is designed to be further small. As a result, it is possible to design the thickness of the feeder line of the antenna device to be further small.

In the second embodiment, an example in which the ground conductors 11*a* to 11*i* whose one ends are connected to the ground conductor 1 and the other ends are connected to the ground conductor 3, respectively, are provided between the ground conductor 1 and the ground conductor 3 as the conductors for disturbing the electromagnetic field is described. Alternatively, the configuration illustrated in FIG. 8 may be adopted, in which, although one end of each of the ground conductors 11*a* to 11*i* is connected to the ground conductor 1, the other end thereof is not connected to the ground conductor 3 but extends to the vicinity of the ground conductor 3.

Figure 9:
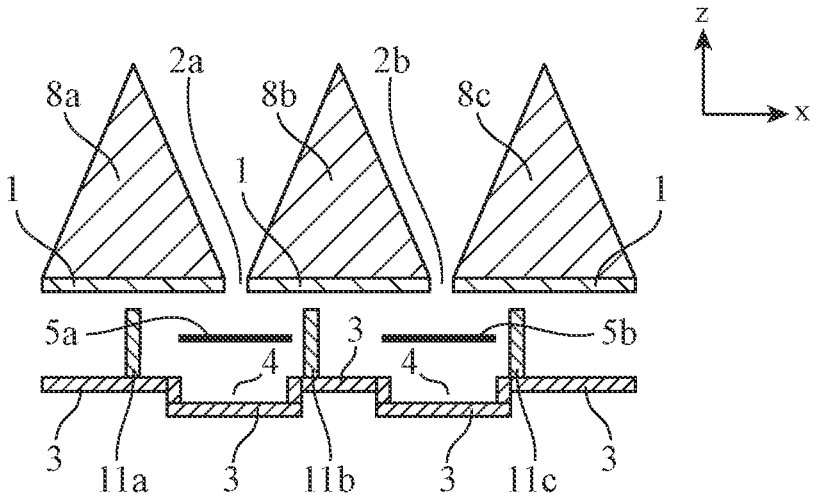
FIG. 9 is a cross-sectional view taken along line A-A' in the antenna device in FIG. 6.

Further, the configuration illustrated in FIG. 9 may be adopted, in which, although the other end of each of the ground conductors 11*a* to 11*i* is connected to the ground conductor 3, one end thereof is not connected to the ground conductor 1 but extends to the vicinity of the ground conductor 1.

Figure 8:
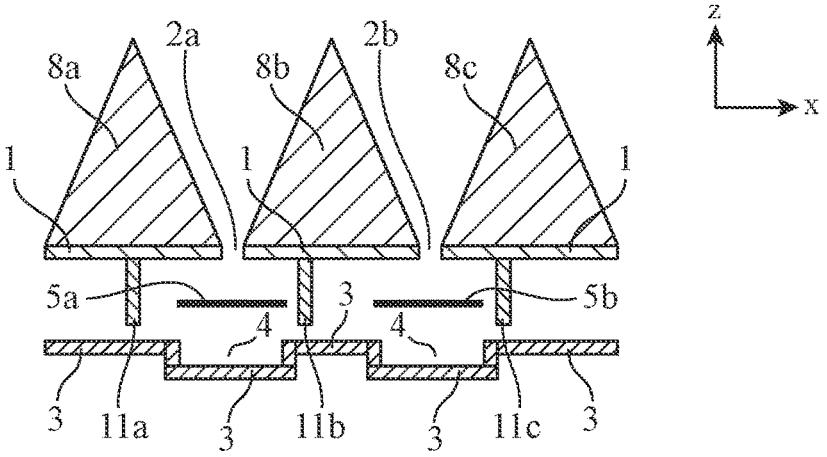
FIG. 8 is a cross-sectional view taken along line A-A' in the antenna device in FIG. 6.

FIGS. 8 and 9 are cross-sectional views taken along line A-A' of the antenna device in FIG. 6. Note that, in FIGS. 8 and 9, the antenna device in a state in which the ground conductor 1 is not removed is illustrated.

In this manner, even in cases in which one end or the other end of each of the ground conductors 11*a* to 11*i* are not connected to the ground conductor 1 or 3, the ground conductors 11*a* to 11*i* serve as discontinuous points when electromagnetic waves propagate. As a result, it is possible to break the stable state as in the case in which both ends thereof are connected thereto.

In the second embodiment, an example in which each of the ground conductors 11*a* to 11*i* is plate-shaped is described. However, the shape is not limited to the plate shape, and each of the ground conductors 11*a* to 11*i* may be bar-shaped, for example.

Third Embodiment

In the above-described second embodiment, the ground conductors 11*a* to 11*i* whose one ends are connected to the ground conductor 1 and the other ends are connected to the ground conductor 3, respectively, are provided between the ground conductor 1 and the ground conductor 3 as the conductors for disturbing the electromagnetic field. Alternatively, another configuration may be adopted in which second central conductors are connected to the ends of the central conductors 5*a*, 5*b*, 6*a*, 6*b*, 6*c*, 7*a*, and 7*b*, respectively, as disturbing conductors.

Figure 10:
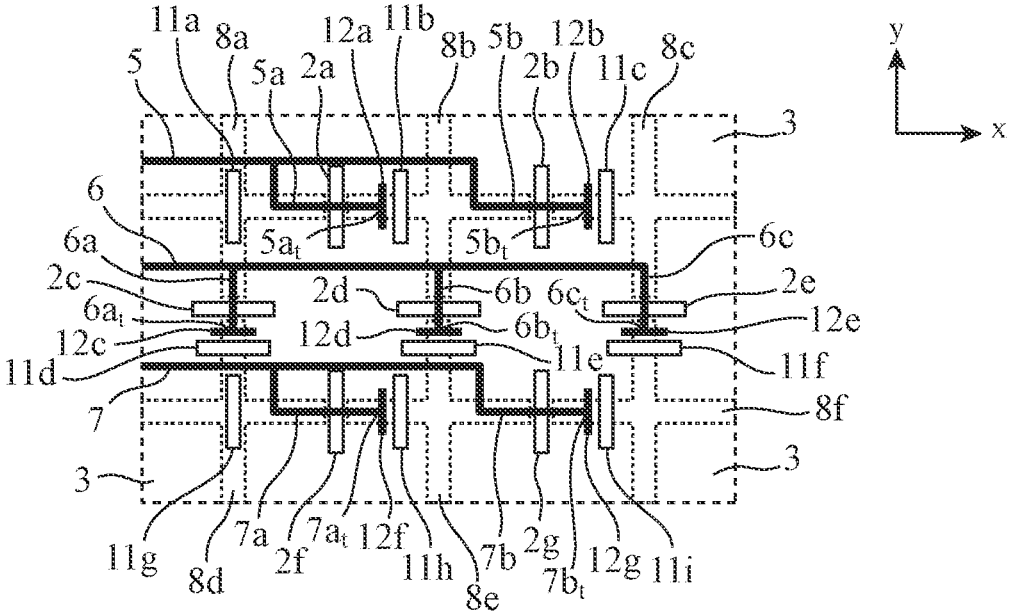
FIG. 10 is a top view illustrating an antenna device according to a third embodiment of the present invention.

FIG. 10 is a top view illustrating an antenna device according to a third embodiment of the present invention. Note that, in FIG. 10, a state in which a ground conductor 1 is removed from the antenna device and central conductors 5, 6, and 7 are visible is illustrated.

In FIG. 10, the same reference signs as those in FIGS. 3 and 6 represent the same or corresponding parts, so that the description thereof is omitted.

Central conductors 12*a*, 12*b*, 12*c*, 12*d*, 12*e*, 12*f*, and 12*g* are used as disturbing conductors for disturbing an electromagnetic field between the ground conductor 1 and a ground conductor 3.

The central conductors 12*a* and 12*b* are the second central conductors connected to ends $5a_t$ and $5b_t$ of central conductors 5*a* and 5*b* at the right angle with respect to the central conductors 5*a* and 5*b*, respectively, to be arranged in the same plane as the central conductors 5*a* and 5*b*.

The central conductors 12*c*, 12*d*, and 12*e* are the second central conductors connected to ends $6a_t$, $6b_t$, and $6c_t$ of central conductors 6*a*, 6*b*, and 6*c* at the right angle with respect to the central conductors 6*a*, 6*b*, and 6*c*, respectively, to be arranged in the same plane as the central conductors 6*a*, 6*b*, and 6*c*.

The central conductors 12*f* and 12*g* are the second central conductors connected to ends $7a_t$ and $7b_t$ of central conductors 7*a* and 7*b* at the right angle with respect to the central conductors 7*a* and 7*b*, respectively, to be arranged in the same plane as the central conductors 7*a* and 7*b*.

Next, the operation of the antenna device in this embodiment will be described.

In order to break a stable state so that electromagnetic waves can be radiated from slots 2*a* to 2*g* formed in the ground conductor 1 to the space even when the depth of the cavities 4 is small, in the third embodiment, the central conductors 12*a* to 12*g* are provided as the conductors for disturbing the electromagnetic field between the ground conductor 1 and the ground conductor 3. The central conductors 12*a* to 12*g* serve as discontinuous points when electromagnetic waves propagate.

By this configuration, the electromagnetic field in a triplate line is disturbed by an effect of the discontinuous points provided by the central conductors 12*a* to 12*g*, so that the stable state can be broken. As a result, it becomes possible to radiate the electromagnetic waves from the slots 2*a* to 2*g* to the space.

As can be understood from the above description, according to the third embodiment, the central conductors 12*a* to 12*g* connected to the ends $5a_t$, $5b_t$, $6a_t$, $6b_t$, $6c_t$, $7a_t$, and $7b_t$ of the central conductors 5*a*, 5*b*, 6*a*, 6*b*, 6*c*, 7*a*, and 7*b* and arranged in the same plane as the central conductors 5*a*, 5*b*, 6*a*, 6*b*, 6*c*, 7*a*, and 7*b* are provided as the conductors for disturbing the electromagnetic field between the ground conductors 1 and 3. As a result, even in a case in which the thickness of each of feeder lines formed of the ground conductors 1 and 3 and the central conductors 5*a*, 5*b*, 6*a*, 6*b*, 6*c*, 7*a*, and 7*b* is designed to be small, there is an effect that the stable state is broken and electromagnetic waves can be radiated from the slots 2*a* to 2*g* to the space.

In this third embodiment, an example in which the central conductors 12*a* to 12*g* are connected to the ends $5a_t$, $5b_t$, $6a_t$, $6b_t$, $6c_t$, $7a_t$, and $7b_t$ of the central conductors 5*a*, 5*b*, 6*a*, 6*b*, 6*c*, 7*a*, and 7*b*, respectively, is described. Further, the central conductors 5*a*, 5*b*, 6*a*, 6*b*, 6*c*, 7*a*, and 7*b* may also be arranged such that the ground conductor 1 is closer to them than the ground conductor 3 as similar to the above-described first embodiment. In this case, the number of elements which break the stable state increases, so that it is possible to break the stable state even when the depth of the cavity 4 is designed to be further small. As a result, it is possible to design the thickness of the feeder line of the antenna device to be further small.

Moreover, as in the above-described second embodiment, ground conductors 11*a* to 11*i* may be provided between the ground conductor 1 and the ground conductor 3. In the example in FIG. 10, the ground conductors 11*a* to 11*i* are provided. By this configuration, the number of elements which break the stable state increases, so that it is possible to break the stable state even when the depth of the cavity 4 is designed to be further small. As a result, it is possible to design the thickness of the feeder line of the antenna device to be further small.

In the third embodiment, an example in which the central conductors 12*a* to 12*g* are connected at the right angle to the ends $5a_t$, $5b_t$, $6a_t$, $6b_t$, $6c_t$, $7a_t$, and $7b_t$ of the central conductors 5*a*, 5*b*, 6*a*, 6*b*, 6*c*, 7*a*, and 7*b*, respectively, is described. However, it is only required for the central conductors 12*a* to 12*g* to serve as discontinuous points when electromagnetic waves propagate, and the connection angle is not limited to the right angle. Therefore, for example, the central conductors 12*a* to 12*g* may also be connected to the ends $5a_t$, $5b_t$, $6a_t$, $6b_t$, $6c_t$, $7a_t$, and $7b_t$ of the central conductors 5*a*, 5*b*, 6*a*, 6*b*, 6*c*, 7*a*, and 7*b*, respectively, at the angle of 45 degree or 60 degree, for example.

Fourth Embodiment

Generally, in an isolated triplate line, an electromagnetic field is concentrated in the vicinity of the central conductor. However, in a case in which the central conductors 5, 6, and 7 are arranged to be close to one another or in a case in which discontinuous portions such as the slots 2*a* to 2*g* and the cavities 4 are present as in a case of the antenna devices according to any of the above-described first to third embodiments, electromagnetic waves called as the parallel-plate mode may be generated between the ground conductor 1 and the ground conductor 3. It is known that the attenuation amount of such electromagnetic waves is small, and as a result, the electric characteristics are deteriorated.

In a fourth embodiment, a configuration in which coupling suppressing conductors are provided for forcibly block coupling among triplate lines will be explained. The coupling suppressing conductors are provided on both sides of each of the central conductors 5, 6, and 7 in order to suppress the electromagnetic waves called as the parallel-plate mode.

Figure 11:
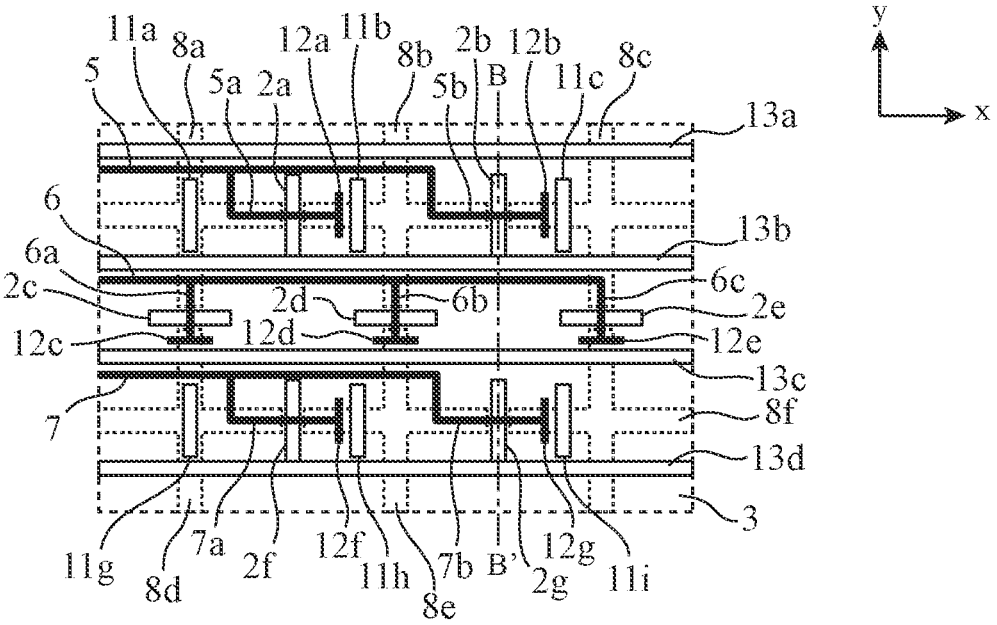
FIG. 11 is a top view illustrating an antenna device according to a fourth embodiment of the present invention.

FIG. 11 is a top view illustrating an antenna device according to the fourth embodiment of the present invention.

Note that, in FIG. 11, a state in which a ground conductor 1 is removed from the antenna device and the central conductors 5, 6, and 7 are visible is illustrated.

Figure 12:
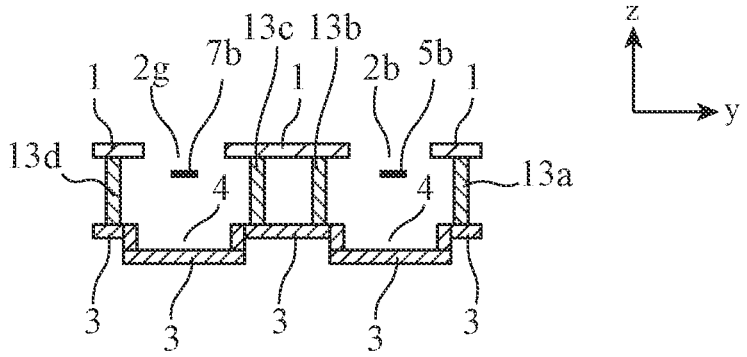
FIG. 12 is a cross-sectional view taken along line B-B' in the antenna device in FIG. 11.

FIG. 12 is a cross-sectional view taken along line B-B' in the antenna device in FIG. 11. Note that, FIG. 12 illustrates the antenna device in a state in which the ground conductor 1 is not removed.

In FIGS. 11 and 12, the same reference signs as those in FIGS. 1 to 10 represent the same or corresponding parts, so that the description thereof is omitted.

Side walls 13*a*, 13*b*, 13*c*, and 13*d* are used as the coupling suppressing conductors.

The side wall 13*a* is arranged on one side of the central conductor 5, one end thereof is connected to the ground conductor 1, and the other end thereof is connected to the ground conductor 3. The side wall 13*b* is arranged on the other side of the central conductor 5 and on one side of the central conductor 6, one end thereof is connected to the ground conductor 1, and the other end thereof is connected to the ground conductor 3.

The side wall 13*c* is arranged on the other side of the central conductor 6 and on one side of the central conductor 7, one end thereof is connected to the ground conductor 1, and the other end thereof is connected to the ground conductor 3. The side wall 13*d* is arranged on the other side of the central conductor 7, one end thereof is connected to the ground conductor 1, and the other end thereof is connected to the ground conductor 3.

In an example in FIG. 11, the side wall 13*a* is arranged on the upper side of the central conductor 5 on the drawing sheet, and the side wall 13*b* is arranged between the central conductor 5 and the central conductor 6. The side wall 13*c* is arranged between the central conductor 6 and the central conductor 7, and the side wall 13*d* is arranged on the lower side of the central conductor 7 on the drawing sheet.

In the antenna device in FIG. 11, the side walls 13*a* to 13*d* are applied to the antenna device of the third embodiment described before. However, the side walls 13*a* to 13*d* may be applied to the antenna devices of the first and second embodiments described before.

Next, the operation of the antenna device in this embodiment will be described.

Components other than the side walls 13*a* to 13*d* are similar to those in the first to third embodiments described before, the side walls 13*a* to 13*d* are mainly described below.

Since the side walls 13*a* to 13*d* are conductors arranged to isolate the central conductors 5, 6, and 7 from one another, the triplate line including the central conductor 5, the triplate line including the central conductor 6, and the triplate line including the central conductor 7 are isolated from one another.

By this configuration, even in a case in which the central conductors 5, 6, and 7 are arranged to be close to one another or even in a case in which discontinuous portions such as slots 2*a* to 2*g* and cavities 4 are present, the coupling among the triplate lines can be forcibly blocked.

Therefore, generation of electromagnetic waves between the ground conductor 1 and the ground conductor 3 called as the parallel-plate mode can be prevented.

FIG. 13 is an illustrative view showing electromagnetic field simulation results for the antenna device according to the fourth embodiment of the present invention.

Figure 13A:
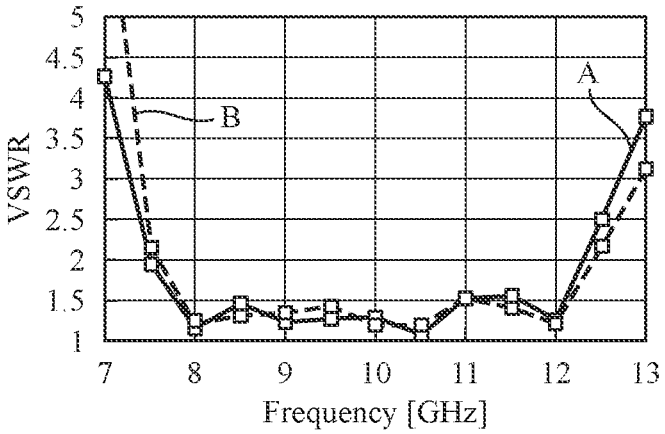
FIG. 13A is a diagram for explaining reflection characteristics of the horizontal polarization A and reflection characteristics of the vertical polarization B.
Figure 13B:
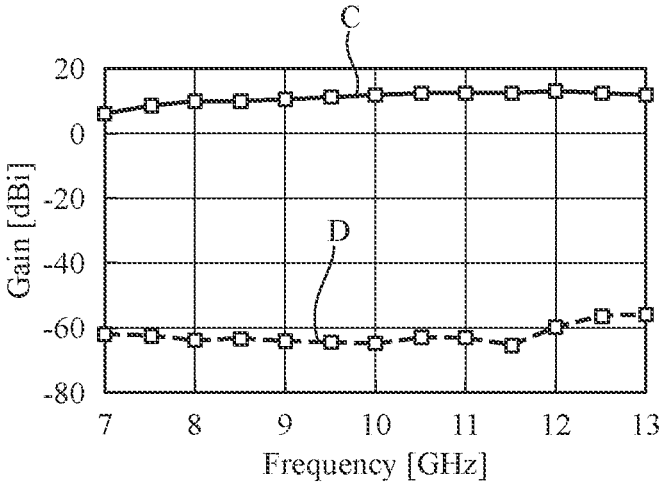
FIG. 13B is a diagram for explaining frequency characteristics of the main polarization gain C and frequency characteristics of the cross polarization gain D in the boresight direction at the time of horizontal polarization excitation.

FIG. 13A illustrates reflection characteristics of the horizontal polarization A and reflection characteristics of the vertical polarization B, and FIG. 13B illustrates frequency characteristics of the main polarization gain C and the frequency characteristics of the cross polarization gain D in the boresight direction at the time of horizontal polarization excitation.

Figure 13C:
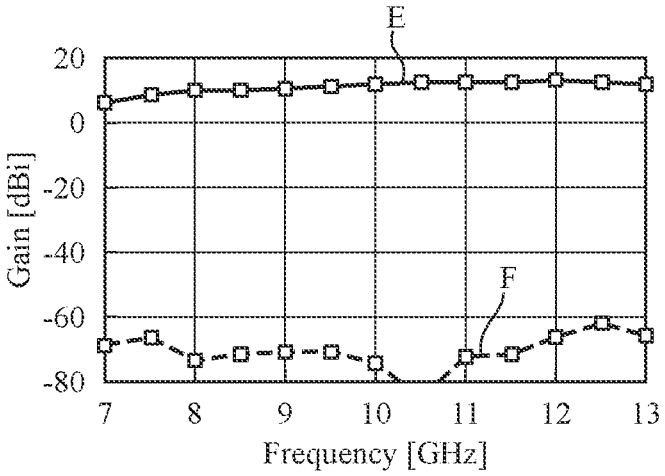
FIG. 13C is a diagram for explaining frequency characteristics of the main polarization gain E and frequency characteristics of the cross polarization gain F in the boresight direction at the time of vertical polarization excitation.

FIG. 13C illustrates frequency characteristics of the main polarization gain E and frequency characteristics of the cross polarization gain F in the boresight direction at the time of vertical polarization excitation.

In this electromagnetic field simulation, it is assumed that the depth of the cavity 4 is 0.08 wavelength.

From the reflection characteristics of the horizontal polarization A and the reflection characteristics of the vertical polarization B illustrated in FIG. 13A, the band in which the voltage standing wave ratio (VSWR) is equal to or lower than 1.5 is frequencies of approximately 8 to 12 [GHz]. That is, the band in which the VSWR is equal to or lower than 1.5 becomes a wide band of approximately 40% (=((12−8)/10)× 100%).

For this reason, it can be said that in the antenna device in FIGS. 11 and 12, input/output impedance matching is achieved over a wide band.

From FIG. 13B, at the time of horizontal polarization excitation, an excellent cross polarization level of 50 dB or higher (=the frequency characteristic of the main polarization gain C—the frequency characteristic of the cross polarization gain D) is obtained.

From FIG. 13C, also at the time of vertical polarization excitation, an excellent cross polarization level of 50 dB or higher (=the frequency characteristic of the main polarization gain E—the frequency characteristic of the cross polarization gain F) is obtained.

Therefore, it is understood that the antenna device in FIGS. 11 and 12 can implement an excellent cross polarization level at both the time of horizontal polarization excitation and the time of vertical polarization excitation.

As can be understood from the above description, according to the fourth embodiment, as the conductor for forcibly blocking coupling among the triplate lines, the side walls 13*a* to 13*d* are arranged on both sides of each of the central conductors 5, 6, and 7, so that even in a case in which the central conductors 5, 6, and 7 are arranged to be close to each other, or even in a case in which discontinuous portions such as the slots 2*a* to 2*g* or the cavities 4 are present, there is an effect of preventing generation of electromagnetic waves between the ground conductor 1 and the ground conductors 3 called as the parallel-plate mode, thereby preventing deterioration in electric characteristics.

Therefore, it is possible to implement an antenna device capable of performing two-dimensional electronic scanning and orthogonal dual-polarization excitation with excellent electric characteristics.

In the fourth embodiment, the side walls 13*a* to 13*d* are arranged as coupling suppressing conductors. Alternatively, instead of the side walls 13*a* to 13*d*, two or more conductor bars and the like, through which the ground conductor 1 and the ground conductor 3 are electrically connected to each other, may be arranged as the coupling suppressing conductors on both sides of each of the central conductors 5, 6, and 7.

Further, instead of the side walls 13*a* to 13*d*, a choke structure having convex portions or concave portions may be formed on the ground conductor 1 or the ground conductor 3 as the coupling suppressing conductors.

Also in the case in which the conductor bars or the choke structure is provided, it is possible to prevent generation of electromagnetic waves between the ground conductor 1 and the ground conductor 3 called as the parallel-plate mode similarly to the case in which the side walls 13*a* to 13*d* are provided.

In the first to fourth embodiments described above, antenna devices capable of performing the orthogonal dual-polarization excitation are described. However, the present invention is not limited to an antenna device capable of performing the orthogonal dual-polarization excitation and may also be applicable to an antenna device of single polarization excitation.

For example, by removing the central conductors 6*a*, 6*b*, and 6*c*, the slots 2*c*, 2*d*, and 2*e*, and the three cavities 4 corresponding to the slots 2*c*, 2*d*, and 2*e* from the configuration shown in FIG. 2, it can operate as the antenna device of single polarization excitation.

In the above-described first to fourth embodiments, the shape of each of the central conductors 5*a*, 5*b*, 6*a*, 6*b*, 6*c*, 7*a*, and 7*b* is linear. However, for example, as illustrated in FIG. 14, the ends $5a_t$, $5b_t$, $6a_t$, $6b_t$, $6c_t$, $7a_t$, and $7b_t$ of the central conductors 5*a*, 5*b*, 6*a*, 6*b*, 6*c*, 7*a*, and 7*b* may be bent in the vicinity of the slots 2*a* to 2*g*, respectively.

Figure 14:
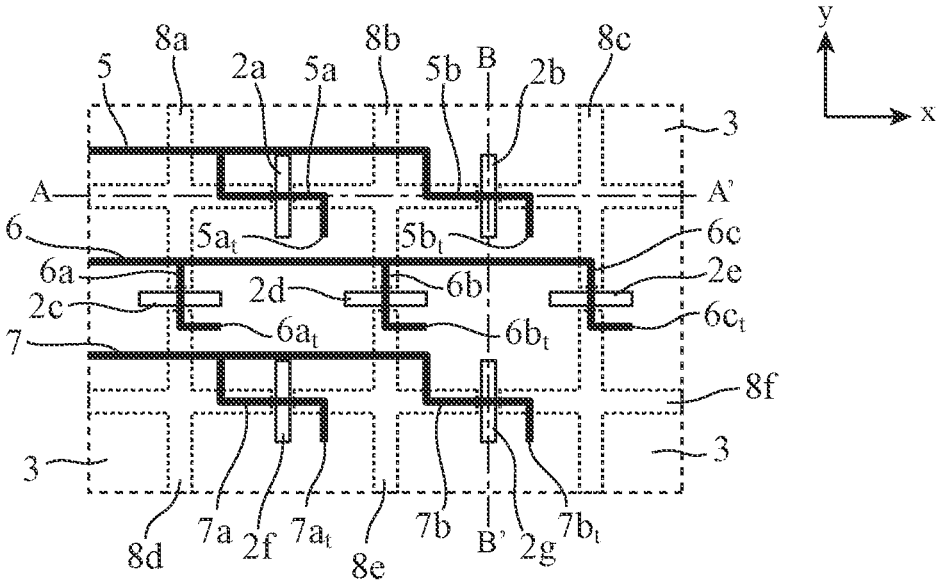
FIG. 14 is a top view illustrating an antenna device according to the fourth embodiment of the present invention.

Note that, FIG. 14 illustrates a state in which the ground conductor 1 is removed from the antenna device and the central conductors 5, 6, and 7 are visible.

In the above-described first to fourth embodiments, it is assumed that the central conductors 5*a*, 5*b*, 6*a*, 6*b*, 6*c*, 7*a*, and 7*b* and the central conductors 12*a* to 12*g* are supported by spacers and the like. However, the supporting means is not limited to the spacers and the like. For example, by arranging a dielectric substrate, on which the central conductors 5*a*, 5*b*, 6*a*, 6*b*, 6*c*, 7*a*, and 7*b* and the central conductors 12*a* to 12*g* are patterned, between the ground conductor 1 and the ground conductor 3, similar electric characteristics can be obtained.

Note that, in the present invention, the above embodiments can be freely combined, any component of each embodiment may be modified, or any component may be omitted in each embodiment without departing from the scope of the invention.

INDUSTRIAL APPLICABILITY

The present invention is suitable for an antenna device in which a triplate line is used as the feeder line and reducing of the thickness of the feeder line is desired.

REFERENCE SIGNS LIST

1: Ground conductor (first ground conductor), 2*a* to 2*g*: Slot (aperture), 3: Ground conductor (second ground conductor), 4: Cavity, 5, 5*a*, 5*b*: Central conductor (first central conductor), 6, 6*a*, 6*b*, 6*c*: Central conductor (first central conductor), 7, 7*a*, 7*b*: Central conductor (first central conductor), $5a_t$, $5b_t$, $6a_t$, $6b_t$, $6c_t$, $7a_t$, $7b_t$: Ends of central conductors 5*a*, 5*b*, 6*a*, 6*b*, 6*c*, 7*a*, and 7*b*, 8*a* to 8*f*: Tapered conductor, 11*a* to 11 *i*: Ground conductor (third ground conductor, disturbing conductor), 12*a* to 12*g*: Central conductor (second central conductor, disturbing conductor), 13*a* to 13*d*: Side wall (coupling suppressing conductor)

The invention claimed is:

1. An antenna device comprising:

a first ground conductor having a slot for radiating an electromagnetic wave;

a second ground conductor on which a cavity recessed in a direction away from the first ground conductor is formed in a position opposite to the slot of the first ground conductor;

a first central conductor arranged between the first ground conductor and the second ground conductor in a position overlapping with the slot;

a third ground conductor configured to disturb an electromagnetic field between the first ground conductor and the second ground conductor, wherein one end of the third ground conductor is conductively connected to the first ground conductor or the second ground conductor, and another end of the third around conductor is proximate to the other of the second ground conductor or the first around; and coupling-suppressing conductors arranged parallel to and on both sides of the first central conductor, each coupling-suppressing conductor having one end electrically connected to the first ground conductor and having another end electrically connected to the second ground conductor.

2. The antenna device according to claim 1, wherein the slot of the first ground conductor is one slot among a plurality of slots of the antenna device, the first central conductor is one first central conductor among a plurality of first central conductors of the antenna device, each slot of the plurality of slots corresponds to a respective first central conductor of the plurality of first central conductors to form an antenna element, and a plurality of the antenna elements are arranged in a two-dimensional array.

3. The antenna device according to claim 1, wherein comprising:

the first central conductor is arranged such that the first ground conductor is closer to the first central conductor than the second ground conductor.

4. An antenna device comprising:

a first ground conductor having a slot for radiating an electromagnetic wave;

a second ground conductor on which a cavity recessed in a direction away from the first ground conductor is formed in a position opposite to the slot of the first ground conductor;

a first central conductor arranged between the first ground conductor and the second ground conductor in a position overlapping with the slot; and a third ground conductor disturbing an electromagnetic field between the first ground conductor and the second ground conductor, wherein one end of the third ground conductor is connected to the first ground conductor or the second ground conductor, and another end of the third ground conductor extends to the vicinity of the second ground conductor or the first ground conductor;

the antenna device further comprises coupling suppressing conductors arranged on both sides of the first central conductor, one end thereof being connected to the first ground conductor, and another end thereof being connected to the second ground conductor.

5. The antenna device according to claim 4, wherein the first ground conductor has a plurality of slots for radiating electromagnetic waves, and wherein a plurality of antenna elements is arrayed in two-dimensional arrangement, each of the plurality of antenna elements including a slot of the plurality of slots of the first ground conductor and the first central conductor.

6. The antenna device according to claim 4, wherein the first central conductor is arranged such that the first ground conductor is closer to the first central conductor than the second ground conductor.

* * * * *